US006247326B1

(12) United States Patent
Likitcheva

(10) Patent No.: US 6,247,326 B1
(45) Date of Patent: Jun. 19, 2001

(54) EVAPORATIVE CONDENSING UNIT UTILIZING NORMAL AND UNSATURATED AIR

(76) Inventor: Pichit Likitcheva, 28/1 Soi Chuasuwan, Udomsuk Praves, Bangkok 10260 (TH)

( * ) Notice: Subject to any disclaimer, the term of this patent is extended or adjusted under 35 U.S.C. 154(b) by 0 days.

(21) Appl. No.: 09/222,464

(22) Filed: Dec. 29, 1998

(51) Int. Cl.[7] ..... F25D 5/00
(52) U.S. Cl. ..... 62/305; 62/279; 62/280
(58) Field of Search ..... 62/305, 279, 280

(56) References Cited

U.S. PATENT DOCUMENTS 2,181,354 * 11/1939 Winters ..... 62/305 X
3,984,995 * 10/1976 Starr et al. ..... 62/305
4,434,112 * 2/1984 Pollock ..... 62/305 X
4,939,907 * 7/1990 Taylor ..... 62/305 X
5,377,500 * 1/1995 Yang ..... 62/305 X
5,946,932 * 9/1999 Wang ..... 62/305
5,950,445 * 9/1999 Wang ..... 62/305 X
5,992,171 * 11/1999 Bacchus ..... 62/305

* cited by examiner

*Primary Examiner*—William Doerrler
*Assistant Examiner*—Chen-Wen Jiang
(74) *Attorney, Agent, or Firm*—Ladas & Parry

(57) ABSTRACT

The present invention made use of the wet and dry type thermometers principle to obtain an improved evaporative condensing unit, both in term of thermal efficiency and in the operating cost, by utilizing normal and therefore still unsaturated air from the surrounding atmosphere in the cooling of the refrigerant fluid.

11 Claims, 4 Drawing Sheets

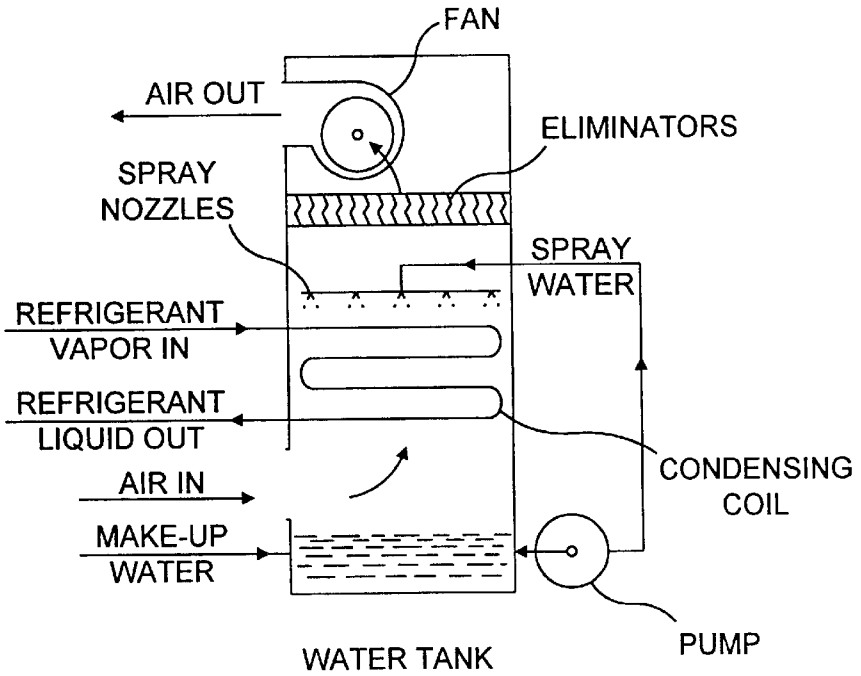
FIG. 4
(PRIOR ART)
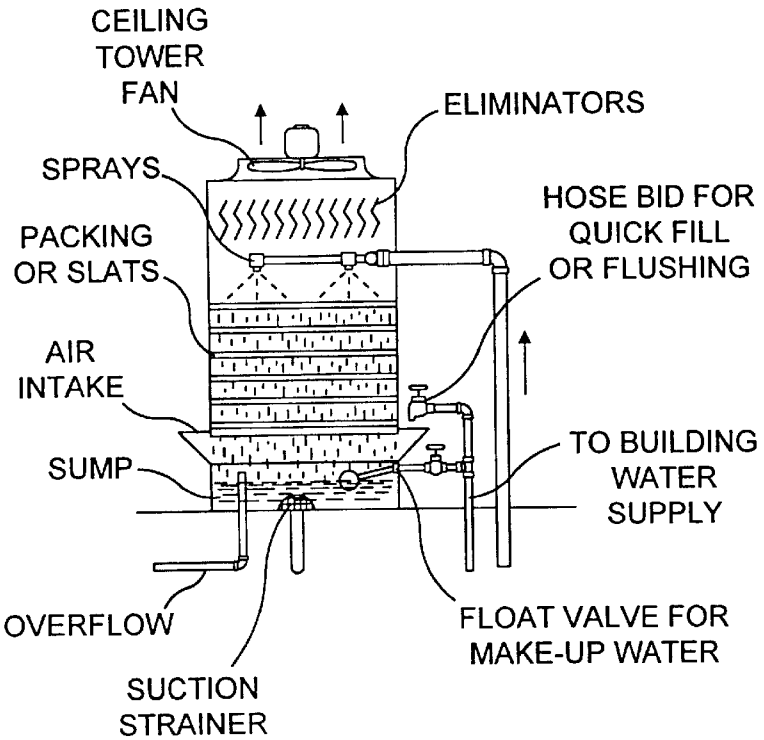

EVAPORATIVE CONDENSING UNIT UTILIZING NORMAL AND UNSATURATED AIR

BACKGROUND OF THE INVENTION

According to the basic principle of dry and wet type thermometers a tests can be made using a simple sling psychrometer wherein one bulb which has been covered with moistened cloth is swung at the rate of approximately 1000 feet per minute. Since the air is made to flow past the thermometer, the temperature reading of the wet bulb will be lower than that of the dry one which is at the atmospheric temperature. The decrease in temperature is due to the evaporation of water from the moistened cloth.

Human body temperature can also be measured with the thermometer. With its natural skin human beings could feel the range of temperature changes from cold to warm through the skin. When the skin is covered with seat as a result of warm weather the body temperature could be lowered by just letting the air flow pass the skin. The evaporating sweat also draws the heat from the body.

In a conventional evaporative condensing unit or chiller, water is pumped up to a higher level before being cascaded down as fine droplets or mist. Air is then blown in an opposite direction to the water flow passing the the refrigerant fluid flowing within conduit of the heat exchanger in order to reduce the temperature of the refrigerant fluid. However, this process involves the use of a high volume of water with a not very high thermal efficiency, because, before reaching the heat exchanger, the air has already been fully saturated while being blown through the mist.

SUMMARY OF THE INVENTION

The invention makes use of dryer air than that being utilized in the conventional process. According to a laboratory testing conducted under a room temperature of a 45 deg C. and 29% relative humidity, a scaled-down unit of chiller equipped with a heat exchanger coil received an in-flow of refrigerant water at the rate of 9 liters per minute and with the inlet temperature of 56 deg C. The refrigerant water within the heat exchanger coil is then cooled down by water that was being pumped up at the rate of 2 liters per minute and sprayed onto a metallic fin of the heat exchanger of the present invention. And concurrently wit the water spraying, the heat exchanger coil was also subjected to an air flow in the same direction by a fan that draws unsaturated air from the surrounding atmosphere. After having gone through such process of the invention the temperature at the outlet of the heat exchanger coil was found to be 21 deg C. lower than the temperature at the inlet.

BRIEF DESCRIPTION OF THE DRAWINGS

FIG. 4 shows a conventional evaporative condensing unit wherein air was already fully saturated by the mist of cooling water before being in contact with the refrigerant conduit.

DETAILED DESCRIPTION OF THE PREFERRED EMBODIMENT

Figure 1:
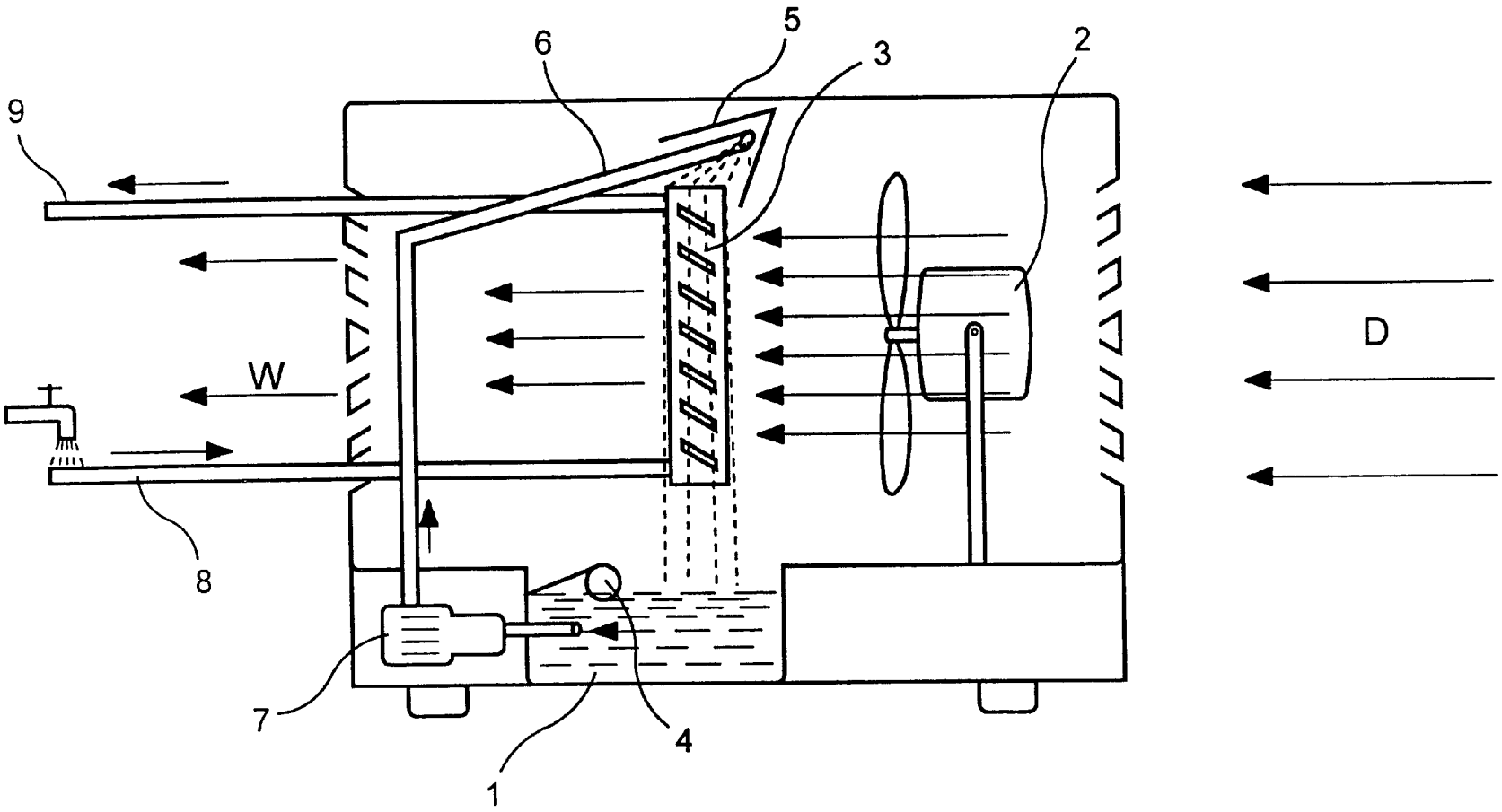
FIG. 1 is a schematic cross sectional view showing an evaporative condensing unit using normal and unsaturated air in accordance with one embodiment of the present invention.

The illustrative embodiment of an evaporative condensing unit utilising normal and unsaturated air according to the present invention shown in FIG. 1 consists of a heat exchanger coil that includes metallic fins 3, an inlet 2 for high temperature fluid refrigerant that flows in the direction as shown by an arrow within a conduit 8, and an outlet 9. Pump 7, drawing water from water container 1 which is regulated by a level regulator 4, pumps the water up through a pipeline 6 and made contact at high pressure against a wall 5. Wall 5 functions as a spray regulator and controls the direction of water flow to within a predetermined perimeter, and therefore reduces the amount of water required. The water droplets then cascade down onto the metallic fins 3 of the heat exchanger coil.

According to the present invention, when fluid refrigerant flows into the conduit 8 from the inlet, fan 2 begins to draw normal air from the surrounding atmosphere D and blows the not-yet saturated air through the metallic fins 3 which were already covered with the water cascade. This unsaturated air will absorb more moisture from the fins 3 than previously possible because of its dryness property. The now fully-saturated air is then blown out at W into the atmosphere.

Figure 2:
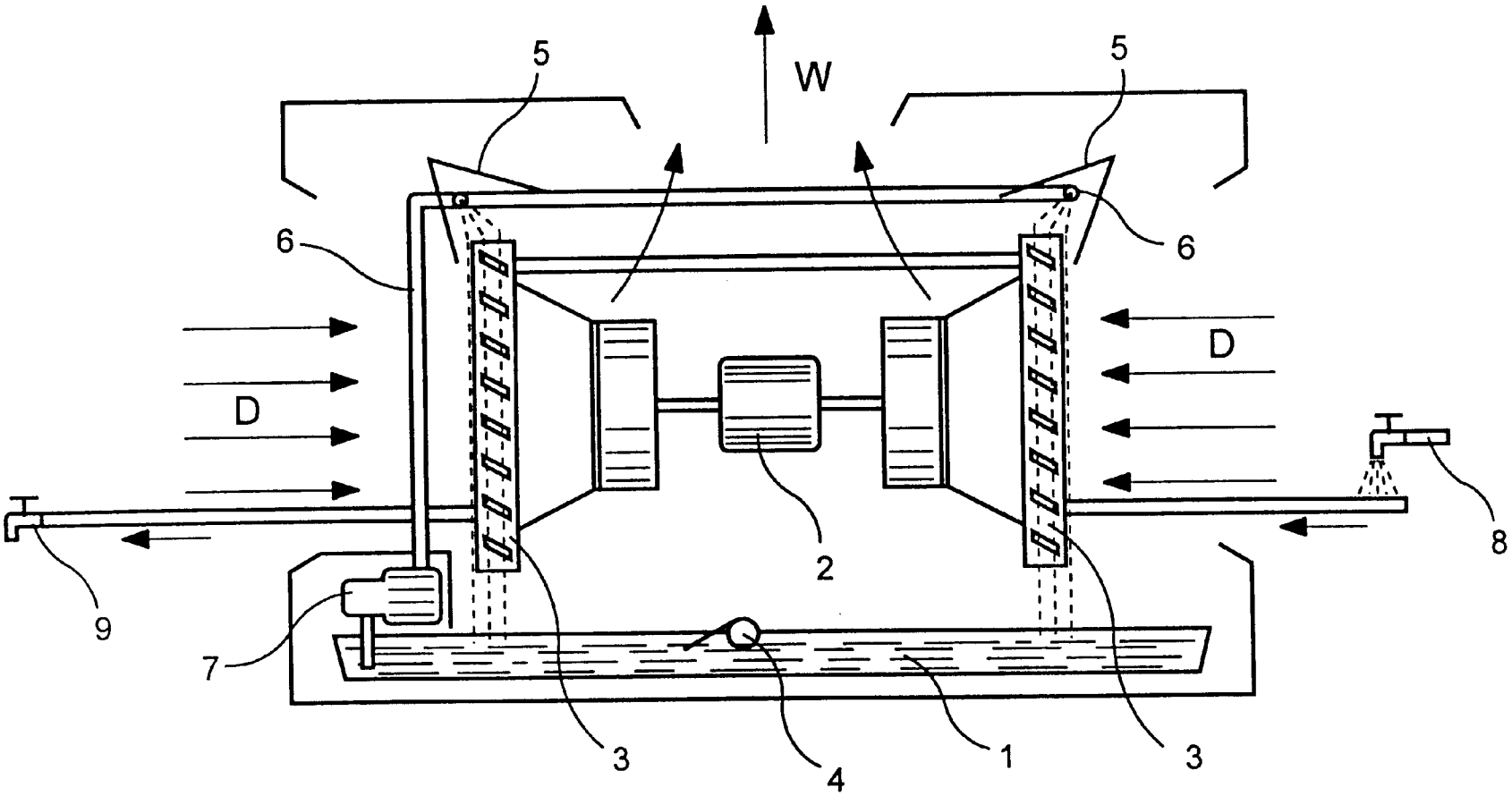
FIG. 2 is a schematic cross sectional view showing an evaporative condensing unit using normal and unsaturated air in accordance with another embodiment of the present invention.
Figure 3:
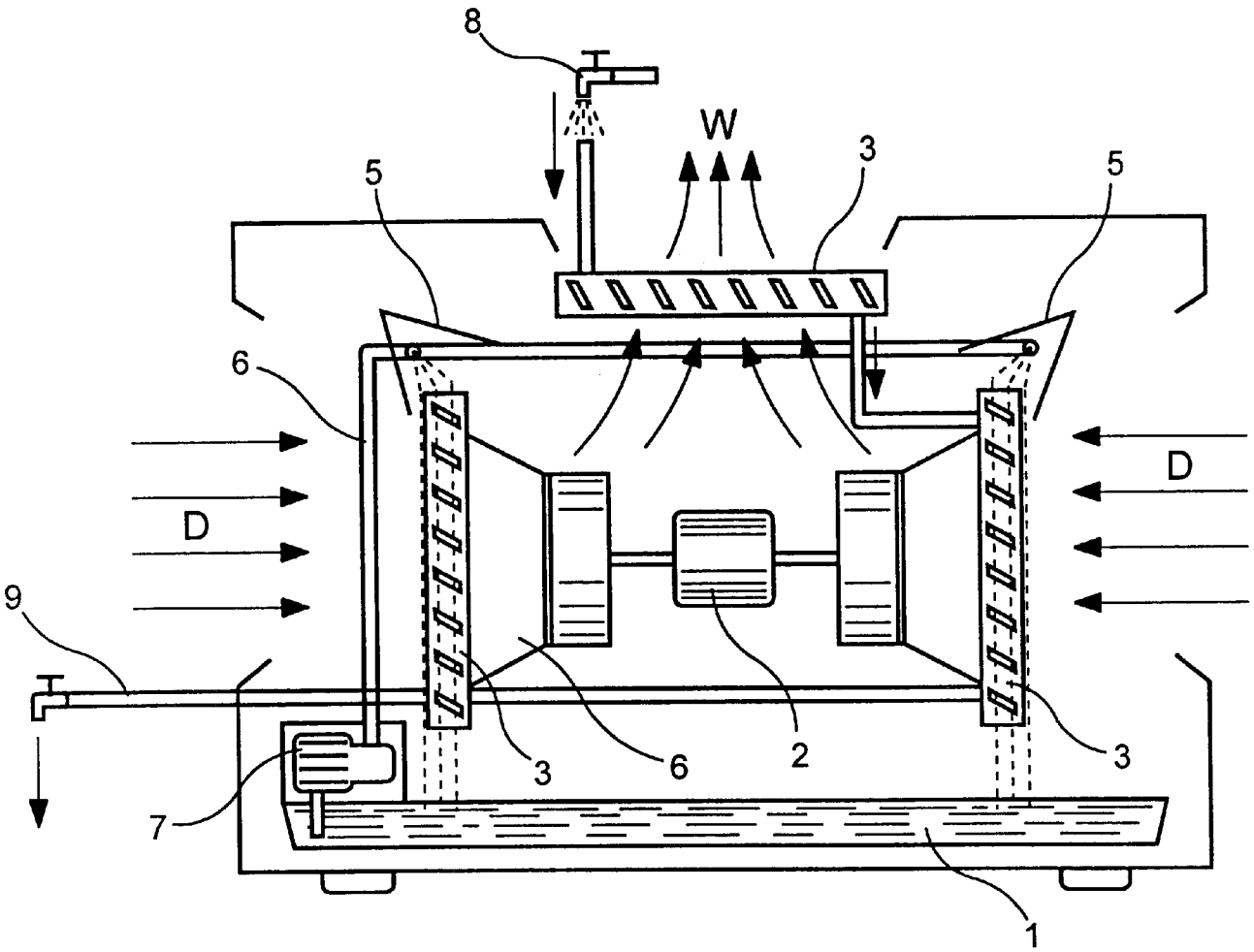
FIG. 3 is a schematic cross sectional view showing a multiple coil type evaporative condensing unit in accordance with yet another embodiment of the present invention.

FIG. 2 shows another embodiment of the present invention wherein two evaporative condensing units of FIG. 1 are incorporated into a single system in order to provide a more extensive cooling effect onto the fluid refrigerant. This type of incorporation involving several evaporative condensing units, as shown in FIG. 3, can readily be achived from the present invention to obtain an even higher thermal efficiency of the system.

It is to be noted that the present invention is not limited to the above description of the illustrated embodiments, and therefore adjustments and/or modifications can be made without diverging from the scope of the present invention.

What is claimed is:

1. An evaporative condensing unit comprising:

a container having an inlet and an outlet for a fluid refrigerant, an air inlet for ambient, unsaturated air, and an air outlet for cooled air, a coil in said container connected to said inlet and outlet for fluid refrigerant for flow of said fluid refrigerant through said coil, said coil being positioned in said container for flow of the ambient air therepast as the air travels from the air inlet to the air outlet, a wall in said container, a water pipeline having an outlet in said container facing said wall, a pump connected to said pipeline to pump water therethrough for discharge from said outlet against said wall, said wall being positioned above said coil so that the water discharged against the wall flows as a cascade downwardly over the coil in said container, said ambient air flowing past said coil and said cascade to undergo cooling and then flowing to said air outlet as cooled air.

2. An evaporative condensing unit as claimed in claim 1, wherein said fluid refrigerant flows upwardly through said coil.

3. An evaporative condensing unit as claimed in claim 2, wherein said air flows from said air inlet to said air outlet in a direction across said coil and said cascade of water.

4. An evaporative condensing unit as claimed in claim 2, comprising fins on said coil.

5. An evaporative condensing unit as claimed in claim 4, wherein said pump has a water inlet in said container for entry therein of water collected in said container from said cascade.

6. An evaporative condensing unit as claimed in claim 1, wherein the water cascade is vertical and the air flows horizontally.

7. An evaporative condensing unit as claimed in claim 6, comprising a fan positioned to blow the air through the container.

8. An evaporative condensing unit as claimed in claim 1, comprising a second coil connected in series with the first said coil, a second wall positioned above said second coil, said pipeline and said second wall providing a second cascade of water onto the second coil, the air flowing in succession through the first and second coils.

9. An evaporative condensing unit as claimed in claim 8, wherein the water flows in one direction through the first coil and in an opposite direction through the second coil.

10. An evaporative condensing unit as claimed in claim 9, comprising a third coil connected in series with the first and second coils, the first and second coils being vertical and parallel, the third coil being horizontal.

11. An evaporative condensing unit as claimed in claim 10, wherein the air flows through the first and second coils in opposite directions and then through the third coil to the air outlet in a direction perpendicular to the flow of air through the first and second coils.

* * * * *